US008763992B2

(12) United States Patent
Imbusch et al.

(10) Patent No.: US 8,763,992 B2
(45) Date of Patent: Jul. 1, 2014

(54) BASE FRAME FOR A LIFTING APPARATUS HAVING REMOVABLE SUPPORT MEMBERS

(75) Inventors: Gereon Imbusch, Mettmann (DE); Thomas Kohlenberg, Paderborn (DE); Franz Schulte, Herdecke (DE); Dingyuan Zhao, Chibi (CN); Wenke Sui, Shanghai (CN); Jinping Zhang, Shanghai (CN)

(73) Assignee: Demag Cranes & Components GmbH, Wetter (DE)

( * ) Notice: Subject to any disclaimer, the term of this patent is extended or adjusted under 35 U.S.C. 154(b) by 12 days.

(21) Appl. No.: 13/510,484

(22) PCT Filed: Nov. 12, 2010

(86) PCT No.: PCT/EP2010/067414

§ 371 (c)(1),
(2), (4) Date: Jul. 3, 2012

(87) PCT Pub. No.: WO2011/061129

PCT Pub. Date: May 26, 2011

(65) Prior Publication Data

US 2012/0280190 A1 Nov. 8, 2012

(30) Foreign Application Priority Data

Nov. 21, 2009 (DE) ..... 10 2009 054 226

(51) Int. Cl.
*B66D 3/00* (2006.01)

(52) U.S. Cl.
USPC ..... 254/380

(58) Field of Classification Search
USPC ..... 254/264, 266, 278, 279, 329, 332, 362, 254/380, 383
See application file for complete search history.

(56) References Cited

U.S. PATENT DOCUMENTS

| | | | |
|---|---|---|---|
| 3,066,917 | A | 12/1962 | Tuplin et al. |
| 3,766,795 | A | 10/1973 | Priest et al. |
| 3,994,476 | A | 11/1976 | van Gennep |
| 4,042,213 | A | 8/1977 | Schreyer et al. |

(Continued)

FOREIGN PATENT DOCUMENTS

| | | | |
|---|---|---|---|
| DE | 561113 | C | 10/1932 |
| DE | 851250 | B | 10/1952 |

(Continued)

OTHER PUBLICATIONS

Translation of the International Preliminary Examination Report on Patentability for corresponding International Application No. PCT/EP2010/067414.

(Continued)

*Primary Examiner* — Emmanuel M Marcelo
*Assistant Examiner* — Angela Caligiuri
(74) *Attorney, Agent, or Firm* — Gardner, Linn, Burkhart & Flory, LLP

(57) ABSTRACT

A lifting apparatus, especially a cable traction mechanism, comprises a base frame that has at least two base plates and at least two longitudinal beams that interconnect the base plates and are spaced apart from each other. Attachment elements are mounted on the base plates by means of holding parts. The lifting apparatus, especially a cable traction mechanism, is characterized by a modular design, where the holding parts are arranged as extensions of the longitudinal beams.

16 Claims, 5 Drawing Sheets

(56) References Cited

U.S. PATENT DOCUMENTS

| | | | | |
|---|---|---|---|---|
| 5,816,564 | A | 10/1998 | Winter | |
| 5,947,450 | A | 9/1999 | Grapes | |
| 6,494,437 | B1 | 12/2002 | Boyer | |
| 6,793,203 | B2 | 9/2004 | Heinrichs et al. | |
| 6,966,544 | B2 | 11/2005 | McCormick et al. | |
| 7,028,989 | B2 | 4/2006 | Flynn et al. | |
| 7,097,157 | B1 | 8/2006 | Lodrick | |
| 7,364,136 | B2 | 4/2008 | Hossler | |
| 7,377,486 | B2 | 5/2008 | Winter et al. | |
| 7,419,137 | B2 | 9/2008 | Boon | |
| 7,469,881 | B2 | 12/2008 | Alipour et al. | |
| 7,766,308 | B2 | 8/2010 | Kochan et al. | |
| 7,850,146 | B2 | 12/2010 | Kempf | |
| 7,909,308 | B2 | 3/2011 | Lauder et al. | |
| 8,313,090 | B2 | 11/2012 | Kempf | |
| 2007/0029533 | A1 | 2/2007 | Winter et al. | |
| 2007/0075174 | A1 | 4/2007 | Kohlenberg | |
| 2008/0061277 | A1 | 3/2008 | Grapes et al. | |
| 2008/0083912 | A1* | 4/2008 | Reznar | 254/323 |
| 2009/0308826 | A1* | 12/2009 | Kempf | 212/270 |
| 2010/0288906 | A1* | 11/2010 | Piech | 248/636 |
| 2012/0061634 | A1 | 3/2012 | Ingelfinger et al. | |
| 2012/0256145 | A1 | 10/2012 | Zhao et al. | |
| 2012/0267592 | A1 | 10/2012 | Zhao et al. | |

FOREIGN PATENT DOCUMENTS

| | | | |
|---|---|---|---|
| DE | 4310770 | A1 | 10/1994 |
| DE | 19602927 | A1 | 7/1997 |
| DE | 102005029113 | B3 | 8/2006 |
| FR | 2928637 | A1 | 9/2009 |
| JP | 48056761 | U | 7/1973 |
| WO | 2008130402 | A2 | 10/2008 |

OTHER PUBLICATIONS

International Search Report from corresponding Patent Cooperation Treaty (PCT) Application No. PCT/EP2010/067414.

Written Opinion from corresponding Patent Cooperation Treaty (PCT) Application No. PCT/EP2010/067414.

Transmittal letter dated Sep. 7, 2011 submitting Article 34 Amendments in corresponding PCT/EP2010/067414.

International Preliminary Examination Report from corresponding Patent Cooperation Treaty (PCT) Application No. PCT/EP2010/067414.

* cited by examiner

BASE FRAME FOR A LIFTING APPARATUS HAVING REMOVABLE SUPPORT MEMBERS

CROSS REFERENCE TO RELATED APPLICATION

The present application claims the priority benefits of International Patent Application No. PCT/EP2010/067414, filed on Nov. 12, 2010, and also of German Patent Application No. DE 10 2009 054 226.4, filed on Nov. 21, 2009, which are hereby incorporated herein by reference in their entireties.

BACKGROUND OF THE INVENTION

The invention relates to a lifting apparatus, in particular a cable winch.

From JP 48 056761 U a cable winch with a cable drum is known, which, via a travelling mechanism of a crane trolley, is suspended on a rail and is able to travel therealong. The cable winch has a base frame formed essentially of two base plates. The base plates are orientated in parallel with respect to each other and are mutually connected at a spaced disposition with respect to each other via bar-like longitudinal beams. The cable drum is disposed between the base plates and mounted at both ends, wherein the axis of rotation of the cable drum extends in parallel with the longitudinal axes of the longitudinal beams. The cable winch is suspended on the travelling mechanism via two bolts. The bolts are, on the one hand, passed through bores in downwardly extended side plates of the travelling mechanism and, on the other hand, through bores in two suspension plates of the cable winch. The suspension plates, which for this purpose are extended upwards beyond the base plates, are disposed between the base plates and at a spaced disposition with respect to each other and also to the respective adjacent base plate. The base plates are suspended or attached on the suspension plates, in that the longitudinal beams are guided through corresponding bores in the suspension plates. In order to be able to set the desired distance between the base plates, bushings are pushed onto the longitudinal beams which lie against the inner sides of the base plates and the outer sides of the suspension plates.

In the citation DE 561 113 C an electrified block and tackle is described with a comparable base frame also receiving the cable drum. A mounting element with an L-shaped cross-section is attached in each case to outer sides of the base plates facing away from the longitudinal beams of the base frame. The mounting elements are in each case placed onto the ends of the lower longitudinal beam protruding on the outer side of the corresponding base plate and clamped via a nut screwed onto the end as an extension of the longitudinal beam and serving as a holding part.

FR 2 928 637 A1 also describes the base frame of a cable winch, the base plates of which are formed essentially as a rectangle and are connected via a total of three tubular longitudinal beams which extend at a spaced disposition and in parallel with the axis of rotation of the cable drum received in the base frame.

There is already known, from German patent application DE 43 10 770 A1, a motor-operated cable winch for lifting work in theatres. This motor-operated cable winch is driven by an electric drive motor which acts on a cable drum via a transmission. The transmission is disposed, together with two brakes, within the cable drum. The cable drum is mounted at both ends in a base frame which substantially consists of two mutually spaced-apart base plates orientated in parallel with each other. The base plates each have a substantially rectangular shape and are attached together via four longitudinal beams orientated in parallel with the longitudinal axis of the cable drum. The longitudinal beams are formed as spacer pipes which are each connected to the base plates in their corner regions by means of a tie rod guided within the spacer pipe and threaded nuts screwed thereto at the ends. The planar end surfaces of the spacer pipes lie against the inner sides of the base plates in the region of through-bores for the tie rods. This motor-operated cable winch is formed as a so-called foot-mounted hoist since the motor-operated cable winches are attached via u-shaped connecting beams, which are open at the top, to a stationary support structure or to a warehouse floor. For attachment of the motor-operated cable winch to the connecting beams, two further holding bores are disposed in the base plates next to the through bores for the longitudinal beams in the region of the lower long side of the base plate, which holding bores serve to attach the base plates via stud bolts to the limbs of the u-shaped connecting beams. For oscillation-damping purposes an elastic element can be disposed between the stud bolt and the holding bores.

SUMMARY OF THE INVENTION

The object of the invention is to create a lifting apparatus, in particular a cable winch, which is characterised by a modular design.

This object is achieved by a lifting apparatus, in particular a cable winch, in accordance with the present invention.

In accordance with an embodiment of the invention, in the case of a lifting apparatus, in particular a cable winch, having a base frame comprising at least two base plates, having at least two longitudinal beams connecting the base plates together keeping them at a spaced disposition with respect to each other and having mounting elements attached to the base plates via holding parts, wherein the holding parts are disposed as an extension of the longitudinal beams and a cable drum is mounted on both ends between and on the inner sides of the base plates, the rotational axis of which cable drum is orientated in parallel with the longitudinal axis of the longitudinal beams, a modular design is achieved by virtue of the fact that the connection between the holding parts and the mounting elements is formed in the manner of a multi-shear, preferably double-shear, bolt connection, in each case two forked lugs each with a forked bore are disposed on the base plates, which forked lugs are disposed in a mutually spaced, opposing manner and defining an aperture, the holding parts are formed in a bolt-like manner and are engaged with the forked lugs. By means of the holding parts a universal interface between the base plates and the mounting elements is created. Furthermore, this arrangement is a particularly space-saving one since the base plates are of sufficient thickness. Mounting is also facilitated since the longitudinal beams and holding parts are attached in one working process. Furthermore, the connection between the holding parts and the mounting elements has a good level of stability.

A simplification of the mounting of the mounting elements is achieved by virtue of the fact that the holding parts are attached to the base plates by connecting elements, such as screws, and at the same time the longitudinal beams are attached to the base plates via these connecting elements.

In a particular manner, the mounting elements are formed as connecting beams for attaching the lifting apparatus to a frame of a crane trolley or are formed as connecting beams for attachment of the lifting apparatus to a stationary support structure.

In one embodiment, provision is made for a mounting lug with a mounting bore to be disposed on the mounting elements.

In order to form a multi-shear bolt connection, the mounting bore of the mounting lug and the forked bores of the forked lugs are aligned with each other and a bolt-like holding part is passed through the forked bores and the mounting bore in order to attach the mounting element to one of the base plates. The holding parts are each attached to the longitudinal beam and to one of the base plates via a screw orientated in the direction of the longitudinal axis of the longitudinal beam.

Provision is made for the base plates to be rectangular, a respective stepped through opening or a through opening being disposed in the corners of an imaginary quadrilateral, in particular a square, in the insides of the base plates, into which through opening in each case one longitudinal beam from a desired number of longitudinal beams is inserted.

A holding element is provided in order to fix the first beam end of the longitudinal beams to the first base plate axially in and against the direction of the longitudinal axis of the longitudinal beam. The holding element is attached to an outer side of the first base plate and has a holding bore into which the first beam end protrudes, and the first beam end is fixed on the holding element via an attachment element, in particular a screw.

In a specific embodiment, provision is made that on the inner side of a second base plate of the at least two base plates, stepped through openings are disposed, into which in each case a second beam end of the longitudinal beams is inserted and attached, that each second beam end of the longitudinal beams is fastened in the stepped through opening via a screw which is orientated in the direction of the longitudinal axis of the longitudinal beam and is supported on the outer side of the second base plate.

Provision is made that the longitudinal beams are formed as bars with a round cross-section.

An exemplified embodiment of the invention will be explained in more detail hereinafter with reference to the accompanying drawings.

DESCRIPTION OF THE PREFERRED EMBODIMENTS

Figure 1:
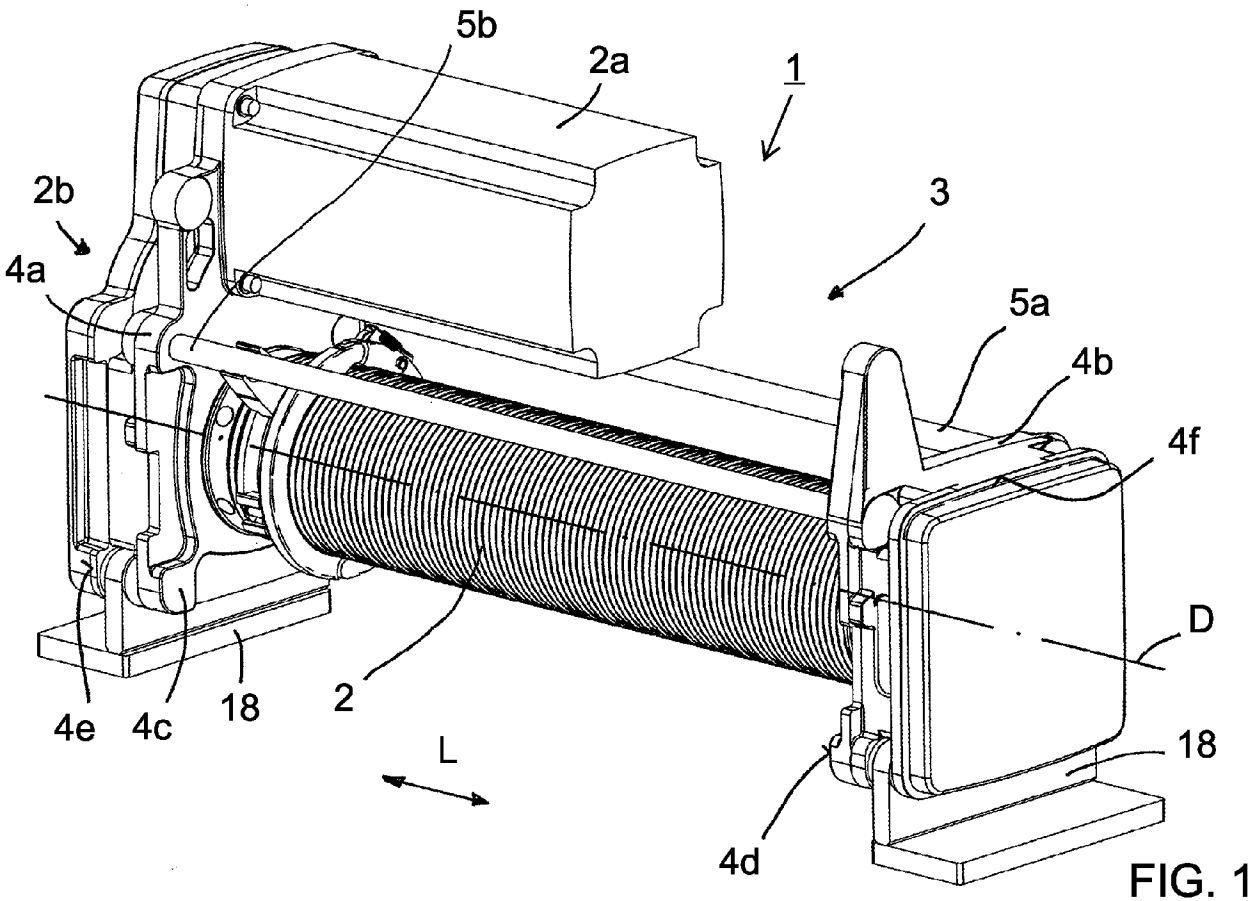
FIG. 1 shows a perspective view of a cable winch in accordance with the invention, formed as a foot-mounted hoist.

FIG. 1 shows a perspective view of a cable winch 1 in accordance with the invention having a cable drum 2 which is mounted at both ends in a base frame 3. The cable winch 1 is arranged as a so-called foot-mounted hoist and, with mounting elements 18 attached to the base frame 3, is set onto a stationary support structure or on a warehouse floor and attached at that location.

The base frame 3, which is on the whole shaped like a cuboid, consists on the one hand of a first base plate 4*a* and a second base plate 4*b*, the cable drum 2 being mounted on the mutually facing first and second inner sides 4*c* and 4*d* thereof. The cable drum 2 is rotatable about a rotational axis D and is driven by an electric motor 2*a* via a transmission 2*b*. The first base plate 4*a* and the second base plate 4*b* are each formed so as to be shaped like a cuboid or to be rectangular.

On the other hand, the base frame 3, shaped like a cuboid, consists of several longitudinal beams, up to a maximum of four, of which a first longitudinal beam 5*a* and a second longitudinal beam 5*b* can be seen in FIG. 1. A third longitudinal beam is disposed below the first longitudinal beam 5*a* and is concealed by the cable drum 2. The base plates 4*a*, 4*b* are spaced apart from each other and connected together via the longitudinal beams 5*a*, 5*b*. The longitudinal beams 5*a*, 5*b* are disposed in the corners of an imaginary quadrilateral in the first and second base plates 4*a*, 4*b*. In the case of the second base plate 4*b*, the longitudinal beams 5*a*, 5*b* are disposed in the corner regions of the virtually square base plate 4*b*. The first base plate 4*a* comprises, compared with the second base plate 4*b*, a rectangular shape since this is extended beyond the first and second longitudinal beam 5*a*, 5*b* for attaching the electric motor 2*a*. In a corresponding manner, the third and possible fourth longitudinal beams are disposed in the region of the lower corner regions of the first base plate 4*a* and the first and second longitudinal beams 5*a*, 5*b* are disposed approximately in the region of the centre and of the side edge of the first base plate 4*a*. Furthermore, this first base plate 4*a* receives the transmission 2*b* in the region of its outer side 4*e*, which transmission connects the cable drum 2 to the electric motor 2*a* in a drivable manner.

The longitudinal beams 5*a*, 5*b* are formed as solid bars and two to four longitudinal beams 5*a*, 5*b* are provided depending upon the usage application of the cable winch 1, said beams being disposed in selected corners, or in all corners, of the base plates 4*a*, 4*b*. The longitudinal beams 5*a*, 5*b* are used to connect the base plates 4*a*, 4*b* together so as to be resistant to twisting and the desired distance and the parallelism between the two base plates 4*a*, 4*b* within the desired tolerances are achieved by the length of the longitudinal beams 5*a*, 5*b*. In the illustrated exemplified embodiment, a total of three longitudinal beams 5*a*, 5*b* are provided so as not to hinder winding and unwinding of a cable, not shown, from the cable drum 2. The longitudinal beams 5*a*, 5*b* each comprise a first beam end 5*d* and an opposite second beam end 5*e*. The first beam ends 5*d* are each attached in the first base plate 4*a* and the second beam ends 5*e* are each attached in the second base plate 4*b*. The specific type of attachment of the first beam ends 5*d* in the first base plate 4*a* and of the second beam ends 5*e* in the second base plate 4*b* is explained in conjunction with FIGS. 3 and 4.

FIG. 1 shows the cable winch in a so-called operating state, i.e., after assembly of the longitudinal beams 5*a*, 5*b*. In this operating state the longitudinal beams 5*a*, 5*b* are orientated with their longitudinal axes L in parallel with and laterally offset from the rotational axis D of the cable drum 2.

FIG. 1 shows a cable winch 1 as a so-called foot-mounted hoist. This cable winch 1 can, when using other mounting elements 18, also become a component of a crane trolley, in which travelling mechanism components are attached to the base plates 4*a*, 4*b*. Possible crane trolley designs include a lower flange crane trolley, a monorail crane trolley with the cable winch 1 arranged next to the rail, and a two-rail crane trolley.

In a corresponding manner, the base plates 4*a* 4*b* have, in addition to mounting the cable drum 2, various other functions such as for example supporting the electric drive 2*a*, receiving mounting cross-beams for parts of a cable reeving arrangement, housing electric equipment, allowing the attachment of feet of the cable winch or mounting parts of travelling mechanisms.

Figure 2:
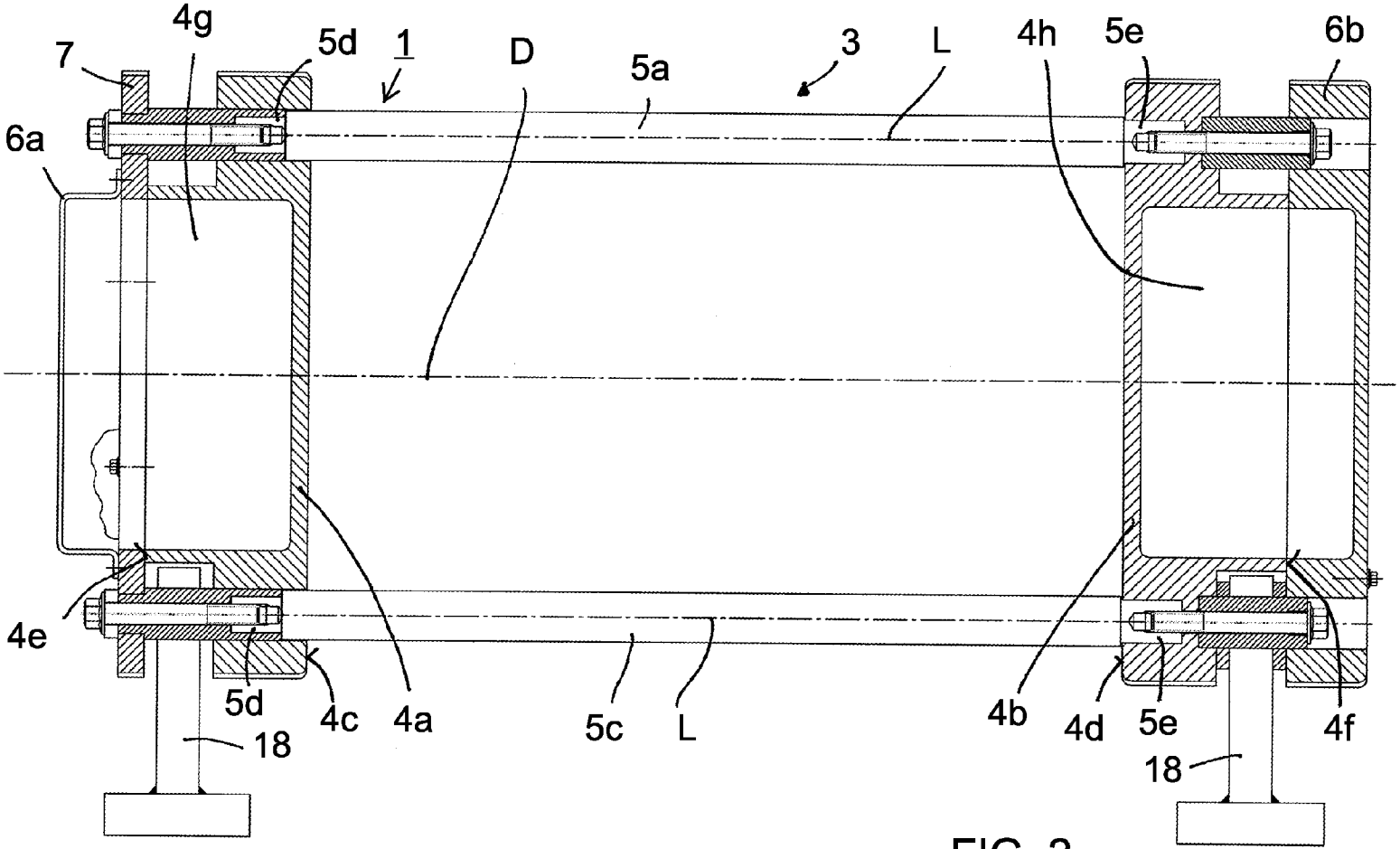
FIG. 2 shows a plan view of FIG. 1 with the cable drum and the electric motor being omitted.

FIG. 2 shows a plan view of the cable winch of FIG. 1, wherein for the sake of clarity the cable drum 2, the transmission 2*b* and the electric motor 2*a* are not shown. It can be seen that the two base plates 4*a*, 4*b* in their own right are produced as cast parts and, so as to save weight, are in the shape of a pot open towards the outside having a first and second hollow space 4*g*, 4*h* respectively in which the drive, electrical or electronic components of the cable winch 1 can be housed. As previously stated, the transmission 2*b* is located in the first hollow space 4*g*. Depending upon requirements and design, the first and second hollow spaces 4*g*, 4*h* can be closed with a cover or can remain open. The first hollow space 4*g* in the first base plate 4*a* is closed by a first cover 6*a* which is attached to a first outer side 4*e* of the first base plate 4*a* via a frame-shaped holding element 7. The second hollow space 4*h* in the second base plate 4*b* is closed by a second cover 6*b* which is directly attached to a second outer side 4*f* of the second base plate 4*b* via a frame-shaped holding element 7.

The configuration of the connection between the beam ends 5*d*, 5*e* and the base plates 4*a*, 4*b* and the connection of mounting elements 18 to the base plates 4*a*, 4*b* will now be explained in more detail with the aid of FIGS. 3 and 4.

Figure 3:
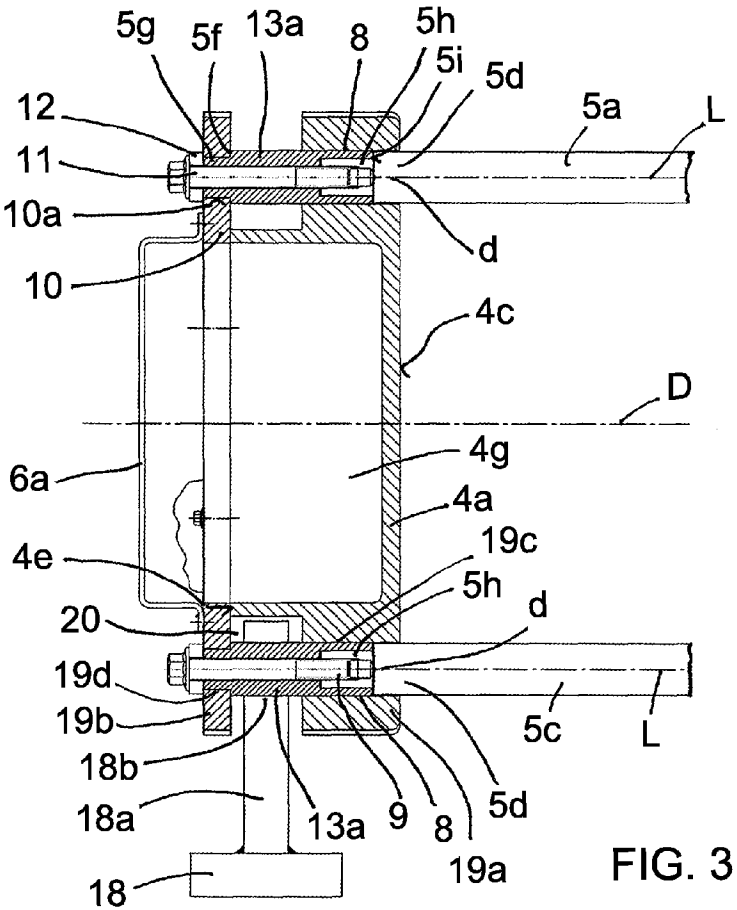
FIG. 3 shows a detailed view of FIG. 2 from the region of the attachment of a longitudinal beam to a first base plate of the base frame.

FIG. 3 shows an enlarged section of FIG. 2 from the region of the first base plate 4*a*. As described previously with respect to FIG. 1, the first base plate 4*a* comprises fastening means for a total of four longitudinal beams 5*a*, 5*b*, or fewer than four longitudinal beams 5*a*, 5*b*, 5*c*, at four different fastening locations. FIG. 3 shows the two rear, namely the first and third, longitudinal beams 5*a*, 5*c*. In order to attach the longitudinal beams 5*a*, 5*c* with their first beam end 5*d* to the first base plate 4*a*, through-openings 8 are arranged in the first base plate 4*a* in the region of the desired fastening locations. Since the longitudinal beams 5*a*, 5*c* are formed as bars having a round cross-section, the through-openings 8 have a passage cross-sectional surface which is slightly larger than the cross-sectional surface of the longitudinal beams 5*a*, 5*b*. The longitudinal beams 5*a*, 5*b* are thus in positive-locking contact with the first base plate 4*a*. The central passage axis d of the through-opening 8 thus coincides with the longitudinal axis L of the longitudinal beams 5*a*, 5*c* in the operating state.

In order to fix the first beam end 5*d* of the longitudinal beams 5*a*, 5*c* in and opposite the longitudinal axis L of the longitudinal beams 5*a*, 5*c*, the diameter of the longitudinal beams 5*a*, 5*c* at the outer end of the first beam end 5*d* is concentrically tapered forming an annular shoulder surface 5*f* and a cylinder protrusion 5*g*. Furthermore, a threaded bore 9, directed in the direction of the longitudinal axis L of the longitudinal beams 5*a*, 5*c*, has an inner thread and is centrally provided in the first beam end 5*d* starting from the outer end surface of the cylinder protrusion 5*g*. The insertion depth of the first beam end 5*a* in the through-opening 8, and thus also the distance between the first and second base plates 4*a*, 4*b*, is selected such that the shoulder surface 5*f* is aligned with the outer side 4*e* of the first base plate 4*a*. In order to keep the longitudinal beam 5*a*, 5*b* in this position as seen in the direction of the longitudinal axis L of the longitudinal beams 5*a*, 5*c*, a holding element 10 having a holding bore 10*a* is provided. The holding element 10 is formed as a rectangular frame having four holding bores 10*a* for each of the through-openings 8 in the first base plate 4*a*. The depth of the holding bores 10*a* is selected such that this is slightly greater than the length of the cylinder protrusion 5*g* of the first beam end 5*d*. A cylinder protrusion 5*g* inserted into the holding bore 10*a* can thus be attached in the holding element 10 via a first screw 11 which is screwed into the threaded bore 9 from the outside. The holding element 10 is clamped between the head of the first screw 11 and the shoulder surface 5*f* of the first beam end 5*d*. In addition, disposed between the head of the screw 11 formed as a cylinder head screw and the outer side of the holding element 10 is a disk 12. The plate-shaped holding element 10 for its part is screwed onto the outer side 4*e* of the first base plate 4*a* via screws, as shown. Moreover, the cover 6*a* for closing the hollow space 4*g* in the first base plate 4*a* is screwed onto the frame-shaped holding element 10 from the outside.

By way of the type of attachment of the first beam ends 5*d* in the through-openings 8 via the holding elements 10 with the screw 11, it is possible, after removing the holding element 10, to pull the longitudinal beams 5*a*, 5*b* out of the first base plate 4*a* in the direction of the longitudinal axis L thereof. It is thus possible to change the position or number of the longitudinal beams 5*a*, 5*b* without removing the cable drum 2.

FIG. 3 further shows that the first beam end 5*a* of the longitudinal beams 5*a*, 5*b* is not formed in one piece but rather comprises a first holding part 13*a* whose outer diameter essentially corresponds to the outer diameter of the longitudinal beams 5*a*, 5*b*, 5*c*. The outer diameter of the first holding part 13*a* is preferably slightly greater than the outer diameter of the longitudinal beams 5*a*, 5*b*, 5*c* so that the longitudinal beams 5*a*, 5*b*, 5*c* can be installed and removed more easily in the longitudinal direction L thereof. The first cylinder protrusion 5*g* and the first shoulder surface 5*f* are then provided on the outer free end of the holding part 13*a*. In order to connect the first holding part 13*a* to the end of the longitudinal beam 5*a*, 5*b*, 5*c*, a second cylinder protrusion 5*h* and a second shoulder surface Si are provided on the end of the longitudinal beam 5*a*, 5*b*, 5*c*, the first holding part 13*a* being placed thereon. The threaded bore 9 is provided in the end of the longitudinal beam 5*a*, 5*b*. Located in the first holding part 13*a* is only one though-going bore without a thread. The placed holding part 13*a* is attached to the end of the longitudinal beam 5*a*, 5*b* via the screw 11.

The first holding part 13*a* serves to attach mounting elements 18 to the first base plate 4*a* as shown in FIG. 1. The mounting element 18 is in this case formed as a foot bracket. The connection of the mounting elements 18, which can be attached to the base plates 4*a*, 4*b* as desired, is formed as a so-called double-shear bolt connection. The bolt required for this purpose is formed by the first holding part 13*a*; one or a plurality of mounting lugs 18*a* are disposed on the mounting element 18 and first and second forked lugs 19*a*, 19*b* are formed by the first base plate 4*a* and the holding element 10, which define an aperture 20 in the first base plate 4*a*. In order to be able to accommodate the first bolt-like holding part 13*a*, a mounting bore 18*b* is disposed in the mounting lug 18*a*, a first forked bore 19*c* is disposed in the first forked lug 19*a* and a second forked bore 19*d* is disposed in the second forked lug 19*b*. In a corresponding manner the first forked bore 19*c*, the mounting element bore 18*b* and the second forked bore 19*d* are aligned with each other and are orientated with their centre axes coaxial to the longitudinal axis L of the longitudinal beams 5*a*, 5*b*. The first forked bore 19*c* is also at the same time the through opening 8 for the longitudinal beams 5*a*, 5*b* and the second forked bore 19*d* is formed by the holding bore 10*a* in the holding element 10. It is particularly advantageous that, in conjunction with an addition or change of mounting elements 18, after removal of the screw 11, of the cover 6*a* and of the holding element 10, the mounting element 18 can be removed with its mounting lug 18*a* in the direction of the longitudinal axis L of the longitudinal beams 5*a*, 5*b*, 5*c* without the longitudinal beams 5*a*, 5*b*, 5*c* or the holding part 13*a* having to be removed and reinstalled. If necessary, the first holding part 13*a* can additionally be removed. In any case, the cable drum 2 can remain between the base plates 4*a*, 4*b*.

Figure 4:
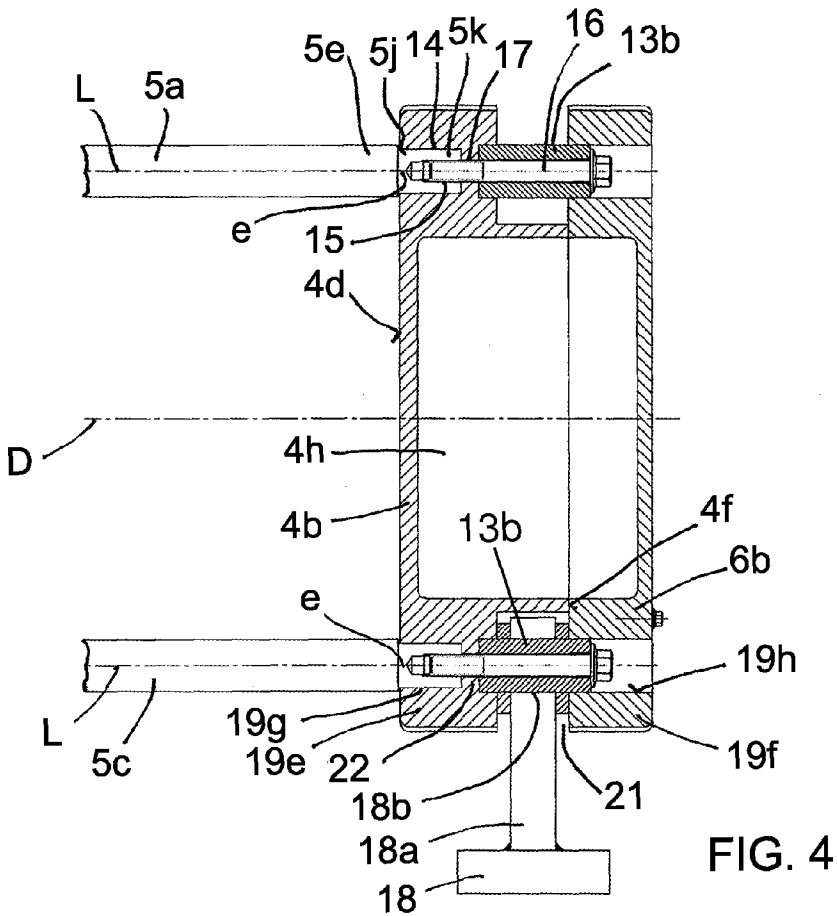
FIG. 4 shows a detailed view of FIG. 2 from the region of the attachment of a longitudinal beam on a second base plate of the base frame and FIG. 5 shows a perspective view of a cable winch in accordance with the invention as a component of a monorail crane trolley in a short design.

FIG. 4 shows an enlarged section of FIG. 2 from the region of the second base plate 4*b*. Just like the first base plate 4*a*, the second base plate 4*b* comprises fastening means for a total of four longitudinal beams 5*a*, 5*b*, 5*c*, or fewer than four longitudinal beams 5*a*, 5*c*, at four different fastening locations. In order to attach the longitudinal beams 5*a*, 5*b*, with their second beam end 5*e* to the second base plate 4*b*, stepped through openings 14 are arranged in the second base plate 4*b* in the region of the desired fastening locations, the cross-sectional surface of the through-openings being slightly larger than the cross-sectional surface of the longitudinal beams 5*a*, 5*b*. A stepped through opening 14 is in this case to be understood as a blind hole bore with a central through bore. The longitudinal beams 5*a*, 5*b* are thus in positive-locking contact with the second base plate 4*b*. The central axis e of the blind hole openings 14 coincides with the longitudinal axis L of the longitudinal beams 5*a*, 5*b* in the operating state. In order to fix the second beam end 5*e* of the longitudinal beams 5*a*, 5*b* in and opposite the longitudinal axis L of the longitudinal beams 5*a*, 5*b* in the stepped through opening 14, the diameter of the longitudinal beam 5*a*, 5*b* at the outer end of the second beam end 5*e* is concentrically tapered forming a third annular shoulder surface 5*j* and a third cylinder protrusion 5*k*.

Furthermore, a threaded bore 15, directed in the direction of the longitudinal axis L of the longitudinal beams 5*a*, 5*c*, has an inner thread and is centrally provided in the second beam end 5*b* starting from the outer end surface thereof. The insertion depth of the second beam end 5*e* in the stepped through opening 14, and thus the distance between the first and second base plates 4*a*, 4*b*, is selected such that the third shoulder surface 5*j* lies against the inner side 4*d* of the second base plate 4*b*. In order to keep the longitudinal beam 5*a*, 5*b* in this position as seen in the direction of the longitudinal axis L of the longitudinal beams 5*a*, 5*c*, a screw 16 is screwed, from the outer side 4*f* of the second base plate 4*b*, into the threaded bore 15 of the second beam end 5*e* through a bore 17 issuing centrally in the base of the stepped through opening 14. The head of the screw 16 formed as a hexagonal socket-headed screw is thus supported on the outer side 4*f* of the second base plate 4*b*.

FIG. 4 shows that the screw 16 is not supported directly with its head on the outer side 4*f* of the second base plate 4*b* but via a second sleeve-like holding part 13*b*, which serves to attach mounting elements 18 to the second base plate 4*b*—as shown in FIG. 1. The mounting element 18 is in turn formed as a foot bracket. The connection of the mounting elements 18, which can be selectively attached to the base plates 4*a*, 4*b*, is again formed as a double-shear bolt connection. The bolt required for this purpose is formed by the second holding part 13*b*; one or more mounting lugs 18*a* are disposed on the mounting element 18 and third and fourth forked lugs 19*e*, 19*f* are formed by the second base plate 4*b* and the second cover 6*b*, which define an aperture 21 in the second base plate 4*b*. In order to be able to receive the second bolt-like holding part 13*b*, a mounting bore 18*b* is disposed in the mounting lug 18*a*, a third forked bore 19*g* is disposed in the third forked lug 19*e* and a fourth forked bore 19*h* is disposed in the fourth forked lug 19*f*. In a corresponding manner, the third forked bore 19*g*, the mounting element bore 18*b* and the fourth forked bore 19*h* are aligned with each other and are orientated with their central axes coaxial to the longitudinal axis L of the longitudinal beams 5*a*, 5*b*. The third forked bore 19*g* is arranged as an extension of the stepped through opening 14 for the longitudinal beams 5*a*, 5*b* in the second base plate 4*b* and is separated by means of a separating wall 22 of the stepped through opening 14 with the bore 17 for the screw 16. It is particularly advantageous that, in conjunction with the addition or changing of mounting elements 18, after removal of the screw 16 and of the second holding part 13*b*, the mounting element 18 can be removed with its mounting lug 18*a* transversely to the longitudinal axis L of the longitudinal beams 5*a*, 5*c*, without the longitudinal beams 5*a*, 5*b* or the second cover 6*b* having to be removed. If necessary, the second holding part 13*b* can remain in place and the second cover 6*b* can be removed. In any case, the cable drum 2 can remain between the base plates 4*a*, 4*b*.

If, in the region of the through openings 8 and of the stepped through openings 14, no longitudinal beams 5*a*, 5*b*, 5*c* are inserted in order to attach the mounting elements 18, stump-like longitudinal support beams are provided for this purpose, which terminate in the region of the inner sides 4*c*, 4*d* of the base plates 4*a*, 4*b*.

Figure 5:
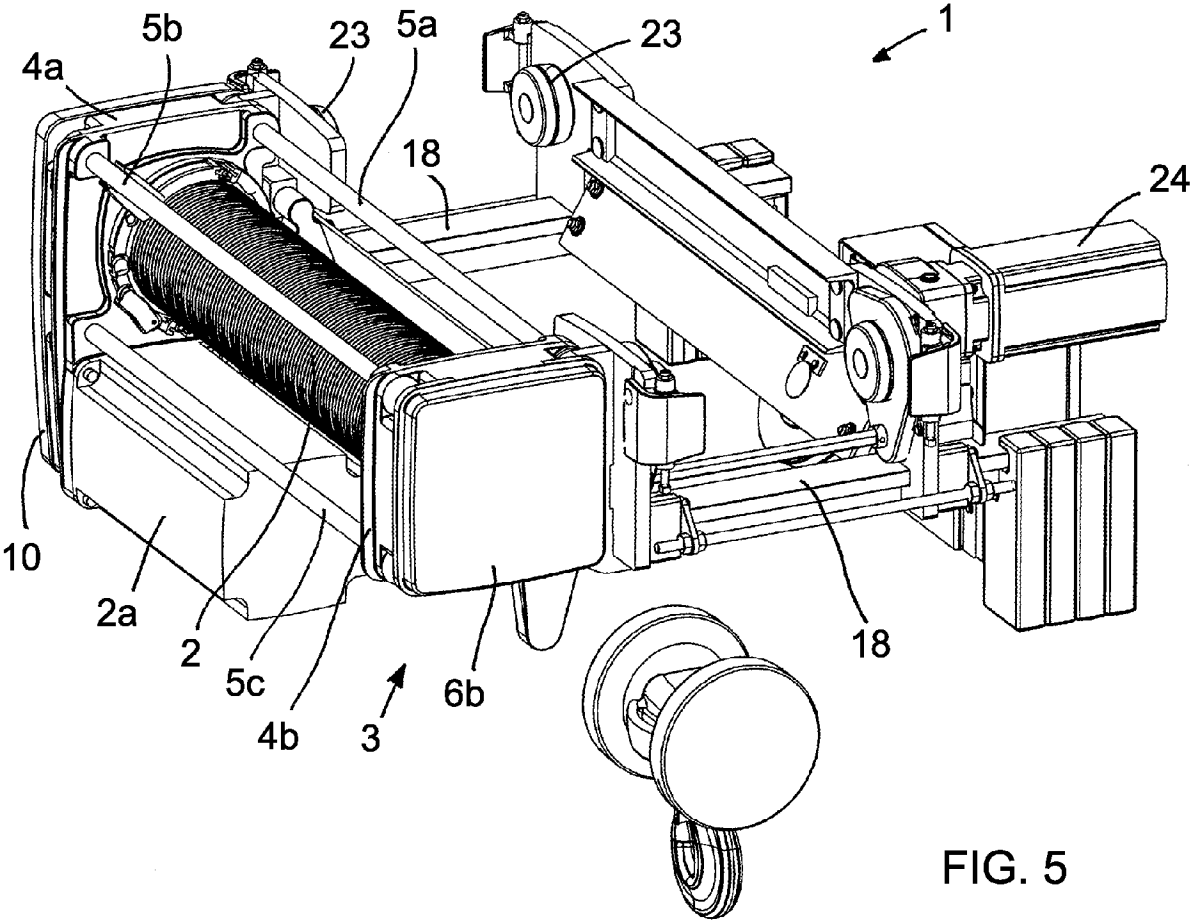

FIG. 5 shows a perspective view of the cable winch 1 in accordance with the invention as a component of a monorail crane trolley in a short design. Compared with the embodiment as a foot-mounted hoist known from FIG. 1, the mounting elements 18 are not holding rails for attaching the cable winch 1 to support structures or a warehouse floor but transverse beams which support parts 23 of the travelling mechanism and a travel drive 24.

LIST OF REFERENCE NUMERALS

1 Cable winch
2 Cable drum
2*a* Electric motor
2*b* Transmission
3 Base frame
4*a* First base plate
4*b* Second base plate
4*c* Inner side of the first base plate 4*a*
4*d* Inner side of the second base plate 4*b*
4*e* Outer side of the first base plate 4*a*
4*f* Outer side of the second base plate 4*b*
4*g* First hollow chamber
4*h* Second hollow chamber
5*a* First longitudinal beam
5*b* Second longitudinal beam
5*c* Third longitudinal beam
5*d* First beam end
5*e* Second beam end
5*f* First shoulder surface
5*g* First cylinder protrusion
5*h* Second shoulder surface
5*i* Second cylinder protrusion
5*j* Third shoulder surface
5*k* Third cylinder protrusion
6*a* First cover
6*b* Second cover
7 Holding element
8 Through-opening
9 Threaded bore
10 Holding element
10*a* Holding bore
11 Screw
12 Disk
13*a* First holding part
13*b* Second holding part

14 Stepped through openings
15 Threaded bore
16 Screw
17 Bore
18 Mounting element
18*a* Mounting lug
18*b* Mounting bore
19*a* First forked lug
19*b* Second forked lug
19*c* First forked bore
19*d* Second forked bore
19*e* Third forked lug
19*f* Fourth forked lug
19*g* Third forked bore
19*h* Fourth forked bore
20 Aperture
21 Aperture
22 Separating wall
23 Parts of the travelling mechanism
Travel drive
D Rotational axis
L Longitudinal axis
d Passage axis
e Axis

The invention claimed is:

1. Cable winch, having a base frame comprising at least two base plates each with an inner side, having at least two longitudinal beams each with a longitudinal axis with the longitudinal beams connecting the base plates together and keeping them at a spaced disposition with respect to each other, and having mounting elements attached to the base plates via holding parts, wherein the holding parts are disposed as an elongation of the longitudinal beams and a cable drum is mounted at both ends between and on the inner sides of the base plates, a rotational axis of the cable drum being orientated in parallel with the longitudinal axis of the longitudinal beams, wherein the connection between the holding parts and the mounting elements is formed in the manner of a multi-shear bolt connection, in each case two forked lugs each with a forked bore are disposed on each base plate, which forked lugs are disposed in a mutually spaced, opposing manner and defining an aperture, the holding parts are formed in a bolt-like manner and are engaged with the forked lugs wherein a mounting lug with a mounting bore is disposed on the mounting elements, wherein the mounting bore of the mounting lug and the forked bores of the forked lugs are aligned with each other in the direction of the longitudinal axis of the longitudinal beam and the bolt-like holding part is disposed in the forked bores and the mounting bore in order to attach the mounting element to one of the base plates.

2. The cable winch as claimed in claim 1, wherein the holding parts are attached to the base plates by connecting elements and at the same time the longitudinal beams are attached to the base plates via these connecting elements.

3. The cable winch as claimed in claim 2, wherein the connecting elements comprise screws.

4. The cable winch as claimed in claim 3, wherein the mounting elements are formed as connecting beams for attaching the cable winch to a frame of a crane trolley or are formed as connecting beams for attachment of the cable winch to a stationary support structure.

5. The cable winch as claimed in claim 4, wherein the holding parts are each attached via a screw orientated in the direction of the longitudinal axis of the longitudinal beam to the longitudinal beam and to one of the base plates.

6. The cable winch as claimed in claim 5, wherein the base plates are rectangular, a respective stepped through opening or a through opening being disposed in the corners of an imaginary quadrilateral in the insides of the base plates, into which through opening in each case one longitudinal beam from a desired number of the longitudinal beams is inserted.

7. The cable winch as claimed in claim 6, wherein a first beam end of the longitudinal beams is fixed by a holding element in and against the direction of the longitudinal axis of the longitudinal beam to the first base plate, the holding element is attached to an outer side of the first base plate, the holding element has a holding bore into which the first beam end protrudes, and the first beam end is fixed on the holding element via an attachment element.

8. The cable winch as claimed in claim 7, wherein on the inner side of a second base plate of the at least two base plates the stepped through openings are disposed, into which in each case a second beam end of the longitudinal beams is inserted and attached, that each second beam end of the longitudinal beams is fastened in the stepped through opening via a screw which is orientated in the direction of the longitudinal axis of the longitudinal beam and is supported on an outer side of the second base plate.

9. The cable winch as claimed in claim 8, wherein the longitudinal beams are formed as bars having a round cross-section.

10. The cable winch as claimed in claim 1, wherein the mounting elements are formed as connecting beams for attaching the cable winch to a frame of a crane trolley or are formed as connecting beams for attachment of the cable winch to a stationary support structure.

11. The cable winch as claimed in claim 1, wherein the holding parts are each attached via a screw orientated in the direction of the longitudinal axis of the longitudinal beam to the longitudinal beam and to one of the base plates.

12. The cable winch as claimed in claim 1, wherein the base plates are rectangular, a respective stepped through opening or a through opening being disposed in the corners of an imaginary quadrilateral in the insides of the base plates, into which through opening in each case one longitudinal beam from a desired number of the longitudinal beams is inserted.

13. The cable winch as claimed in claim 12, wherein a first beam end of the longitudinal beams is fixed by a holding element in and against the direction of the longitudinal axis of the longitudinal beam to the first base plate, the holding element is attached to an outer side of the first base plate, the holding element has a holding bore into which the first beam end protrudes, and the first beam end is fixed on the holding element via an attachment element.

14. The cable winch as claimed in claim 13, wherein on the inner side of a second base plate of the at least two base plates the stepped through openings are disposed, into which in each case a second beam end of the longitudinal beams is inserted and attached, that each second beam end of the longitudinal beams is fastened in the stepped through opening via a screw which is orientated in the direction of the longitudinal axis of the longitudinal beam and is supported on an outer side of the second base plate.

15. The cable winch as claimed in claim 1, wherein the longitudinal beams are formed as bars having a round cross-section.

16. The cable winch as claimed in claim 1, wherein the connection between the holding parts and the mounting elements is formed in the manner of a double-shear bolt connection.

* * * * *